US006459351B1

(12) United States Patent
Maki et al.

(10) Patent No.: US 6,459,351 B1
(45) Date of Patent: Oct. 1, 2002

(54) MULTILAYER COMPONENT HAVING INDUCTIVE IMPEDANCE

(75) Inventors: Hideya Maki; Masanori Tomaru; Kenichi Hoshi, all of Tokyo (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 41 days.

(21) Appl. No.: 09/630,959

(22) Filed: Aug. 2, 2000

(30) Foreign Application Priority Data

Aug. 3, 1999 (JP) ..... 11-219590

(51) Int. Cl.[7] ..... H01F 5/00
(52) U.S. Cl. ..... 336/200; 336/223; 336/232
(58) Field of Search ..... 336/83, 200, 232, 336/223

(56) References Cited

U.S. PATENT DOCUMENTS 5,239,744 A * 8/1993 Fleming et al. ..... 29/602.1
6,045,747 A * 4/2000 Holm ..... 264/618

FOREIGN PATENT DOCUMENTS

| | | |
|---|---|---|
| JP | 55-91103 | 7/1980 |
| JP | 57-55918 | 9/1980 |
| JP | 56-155516 | 12/1981 |
| JP | 56-157011 | 12/1981 |
| JP | 57-173918 | 10/1982 |
| JP | 6-310333 | 11/1994 |

* cited by examiner

*Primary Examiner*—Anh Mai
(74) *Attorney, Agent, or Firm*—Lowe Hauptman Gilman & Berner, LLP

(57) ABSTRACT

A laminate has a structure in which a plurality of first magnetic substances of a strong permeability, and a plurality of second magnetic substances of a low permeability or non-magnetic substances are laminated. The second magnetic substances are located so an inductance element in each of the first magnetic substances causes magnetic saturation to occur by direct currents of different magnitudes to provide a multilayer inductor having optional direct-current characteristics.

11 Claims, 5 Drawing Sheets

MULTILAYER COMPONENT HAVING INDUCTIVE IMPEDANCE

BACKGROUND OF THE INVENTION

The present invention relates to a multilayer component having an inductive impedance.

Conventional multilayer components having inductive impedances have structures formed by applying an Ag-based conductive paste for internal electrodes onto magnetic sheets consisting, for example, of an Ni—Zn—Cu ferrite material in a predetermined pattern, and laminating these magnetic sheets. Internal electrodes formed in adjacent magnetic sheets are connected to each other through via holes, thereby forming a coil in the laminate. On both ends of the laminate are also formed external electrodes connected to the internal electrodes.

Conventional multilayer inductors have direct-current characteristics as FIG. 7 shows. FIG. 7 is a graph showing the direct-current characteristics of a conventional multilayer inductor. The abscissa of the graph indicates the direct current, and the ordinate indicates the inductance. As the graph of FIG. 7 shows, the conventional multilayer inductor has inductance values that are almost constant or gradually decrease to a certain current value as the direct current gradually increases. However, the inductance values rapidly decrease thereafter due to the internal magnetic saturation, and thereby sufficient functions of the inductor cannot be obtained.

In recent years, however, multilayer inductors that have optional direct-current characteristics, unlike conventional multilayer inductors, have been demanded. For example, in an inductor used as a choke coil for a switching power circuit in a small device that has a power-saving mode, the following characteristics are required. That is, when such a device is operated in a power-saving mode, since the working frequency decreases as the load current value applied to the multilayer inductor decreases, an inductance value several to several ten times larger than in the normal prior art mode is required. However, since conventional multilayer inductors have almost constant or slowly decreasing inductance values in the practical current range, they are not suitable for such uses.

BRIEF SUMMARY OF THE INVENTION

It is an object of the present invention to provide a multilayer component having an inductive impedance that can provide different selected direct-current characteristics.

To attain this object, the present invention proposes a multilayer component comprising a laminate formed by laminating conductors that form a coil and insulators, in which the conductors are mutually connected so as to form a coil that has an axis in the laminating direction of the insulators; the laminate comprises a plurality of first insulators including a magnetic substance of high permeability, and at least one second insulator that is placed on the inner layer of the laminate and includes a magnetic substance of low permeability or a non-magnetic substance; and the second insulator is located in the laminate in a manner that the inductor elements in regions divided by the second insulator in the laminating direction produce magnetic saturation by direct currents of different magnitudes.

According to the present invention, since at least one second insulator including a magnetic substance with a low permeability or a non-magnetic substance is located on the inner layer of the laminate, a closed magnetic path is formed in each region divided by the second insulator(s). That is, although one large closed magnetic path is formed in the entire laminate in conventional multilayer inductors, magnetic fluxes are not combined or are significantly weakly combined between divided regions in the multilayer inductor according to the present invention, and a small closed magnetic path is formed in each region.

Since the inductance element in each region causes magnetic saturation to occur in response to different direct current values, the inductance value is stepwise lowered as the magnitude of direct current that is passed through the multilayer inductor gradually increases. Therefore, a multilayer inductor having different selected direct-current characteristics can be obtained easily by suitably adjusting (1) the number of divisions by the second insulator(s), (2) the composition such as permeability, number, and thickness of the first insulators in regions divided by the second insulator (s), and (3) the number of turns of the coil.

The other objects, constitution, and effect of the present invention will be described in detail below.

DETAILED DESCRIPTION OF THE INVENTION

Figure 1:
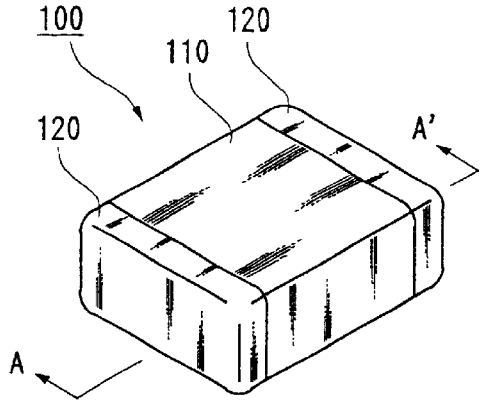
FIG. 1 is a perspective view of a multilayer inductor according to a first embodiment of the present invention.
Figure 2:
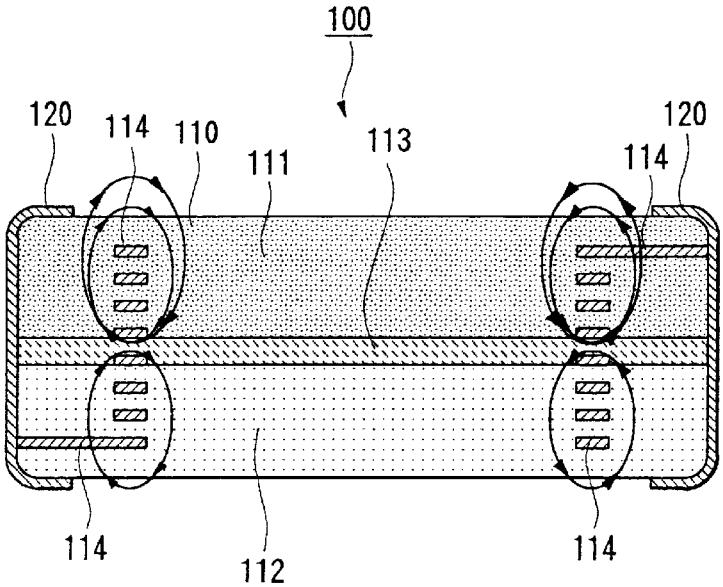
FIG. 2 is a sectional view of a multilayer inductor according to the first embodiment of the present invention taken along the A–A' line in FIG. 1.
Figure 3:
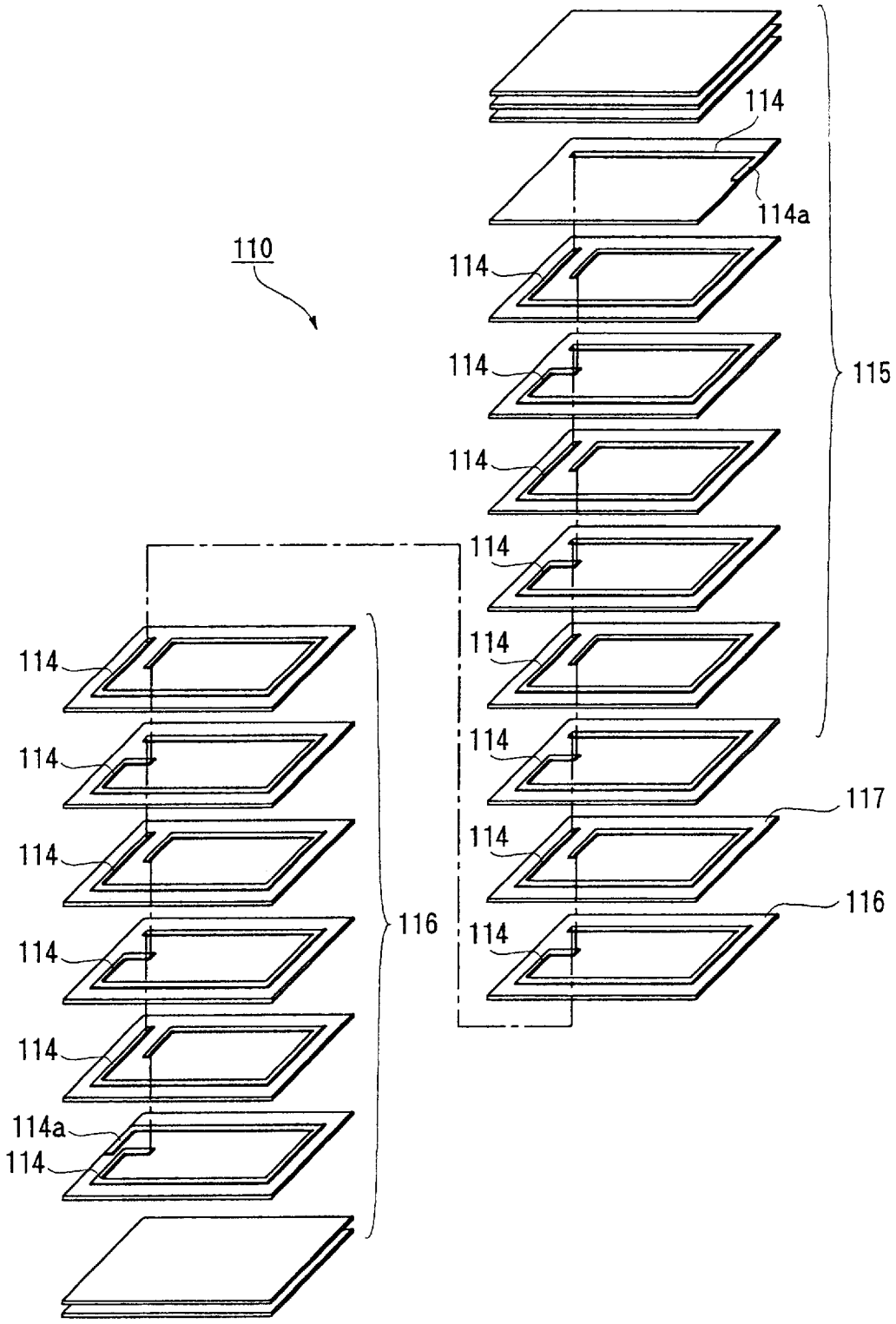
FIG. 3 is an exploded perspective view of a laminate according to the first embodiment of the present invention.

A multilayer inductor according to a first embodiment of the present invention is described referring to FIGS. 1 to 3. FIG. 1 is a perspective view of a multilayer inductor according to the first embodiment of the present invention, FIG. 2 is a sectional view of a multilayer inductor according to the first embodiment of the present invention taken along the A–A' line in FIG. 1, and FIG. 3 is an exploded perspective view of the laminate according to the first embodiment of the present invention. For the convenience of description, the number of turns of the coil and the like are different in FIGS. 2 and 3.

As FIG. 1 shows, a multilayer inductor 100 comprises a substantially rectangular parallelepiped laminate 110 including a magnetic or non-magnetic insulating material, and a pair of external electrodes 120 formed on the both ends of the laminate 110 in the longitudinal direction.

As is shown in FIG. 2, the laminate 110 has a structure formed by laminating a first ferromagnetic layer 111 including an Ni—Zn—Cu ferrite material and having a high permeability; a second ferromagnetic layer 112 including an Ni—Zn—Cu ferrite material and having a permeability smaller than the permeability of the first ferromagnetic layer 111, and a non-magnetic layer 113 including a Zn—Cu ferrite material and having a magnetic permeability $\mu$ of 1. The non-magnetic layer 113 is formed in the inner layer of the laminate 110, i.e., between opposed internal faces of layers 111 and 112.

The permeability of the second ferromagnetic layer 112 is preferably ½ or less than the permeability of the first ferromagnetic layer 111.

It is preferable that the first ferromagnetic layer 111 and the second ferromagnetic layer 112 each have a coefficient of linear temperature expansion that differs only slightly from the coefficient of linear temperature expansion of the non-magnetic layer 113. If there is a large difference of the coefficients of linear temperature expansion between them, cracks or warps may occur in the laminate 110 when the multilayer inductor is packaged. Specifically, a preferable coefficient of linear expansion is $2\times10^{-7}$/° C. or smaller.

Layers 111–113 may get out of alignment with each other on the sides of the laminate 110 because each layer has a composition different from the other layers. It is preferable that the amount by which the layers get out of alignment be 30$\mu$m or less. This is because the yield when the external electrodes 120 are applied to the side of layers 111-113 is decreased.

The thickness of the non-magnetic layer 113 is preferably 5 to 100 $\mu$m, more preferably 10 to 50 $\mu$m. The thickness of less than 5 $\mu$m is not preferable, because combining the layers becomes unstable, resulting in variations in electrical properties of the inductor. Also thicknesses of more than 100 Am are not suitable for down sizing. The multilayer inductor of this embodiment preferably has a thickness of about 1.2 mm in the laminating direction.

Also as FIG. 2 shows, internal electrodes 114, which are conductors that form coils, are embedded in the laminate 110. The axial direction of the coils formed by the internal electrodes 114, that is the flux forming direction in the coils, is the laminating direction of the laminate 110 (the vertical direction of FIG. 2). One end of each coil formed by the internal electrodes 114 is drawn to one end surface of the laminate 110, and the other end is drawn to the other end surface of the laminate 110. The internal electrodes 114 drawn to the end surfaces of the laminate 110 are connected to the external electrodes 120. The internal electrodes 114 and the external electrodes 120 are composed of Ag or an Ag-based metal material.

The further detailed structure of the laminate 110 is described by referring to FIG. 3. As FIG. 3 shows, the laminate 110 has a structure in which a plurality of insulated ferrite sheets are laminated. That is, in the laminate 110, a number of first ferrite sheets 115 that have a high magnetic permeability, a number of second ferrite sheets 116 that have a magnetic permeability lower than the permeability of the first ferrite sheets 115, and one or more (one in FIG. 3) non-magnetic third ferrite sheets 117 are integrally laminated. The first ferrite sheets 115 form the above-described first ferromagnetic layer 111, the second ferrite sheets 116 form the above-described second ferromagnetic layer 112, and the third ferrite sheet 117 forms the above-described non-magnetic layer 113.

In the first ferrite sheets 115 and the second ferrite sheets 116, the internal electrodes 114 of a predetermined pattern are formed except on the several outer sheets (3 upper and 2 lower sheets in FIG. 3) of the laminate 110. The internal electrodes 114 are also formed in the third ferrite sheets 117. The end of the internal electrode 114 formed in each sheet is connected to the internal electrodes 114 in the adjacent sheets through via holes (not shown) in a manner that the entire laminate 110 forms a coil. Also, the ends of the internal electrodes 114 corresponding to the start and end of the coil winding are connected to the outgoing parts 114*a* formed on the edges of the sheets.

The third ferrite sheet 117 is placed in the inner layer of the laminate 110. Specifically, the third ferrite sheet 117 is placed between a plurality of first ferrite sheets 115 and a plurality of second ferrite sheets 116, thereby inhibiting combining of the magnetic field associated with the first ferromagnetic layer 111 formed by the first ferrite sheets 115 with the magnetic field associated with the second ferromagnetic layer 112 formed by the second ferrite sheets 116. As a result, the first ferromagnetic layer 111 has a magnetic field with an intensity that differs from the magnetic field intensity of second ferromagnetic layer 112, as shown by solid arrows in FIG. 2. Therefore, in each region of the laminate 110 divided in the laminating direction by at least one third ferrite sheet 117, that is, in the above-described first ferromagnetic layer 111 and second ferromagnetic layer 112, the inductor element in the region causes magnetic saturation to occur in response to direct currents of different magnitudes.

Next, a method of manufacturing multilayer inductor 100 is described. The description is for manufacturing a large number of multilayer inductors.

First the first, second, and third ferrite sheets 115, 116 and 117 are formed. Specifically, ethyl cellulose and terpineol are added to calcined and ground fine powder of ferrite consisting of $FeO_2$, CuO, ZnO, and NiO. The resulting mixture is kneaded to form a ferrite paste. This ferrite paste is formed into the first ferrite sheets 117 using the doctor-blade method or the like. The second ferrite sheets 116 are formed from the same materials by changing the mixing ratio so as to have a permeability lower than the permeability of the first ferrite sheet. The method for forming the second ferrite sheets 116 is the same as for the first ferrite sheet. A fine ferrite powder consisting of $FeO_2$, CuO, and ZnO is used as the material to form the third ferrite sheet 117.

Then, via holes are formed in these first to third ferrite sheets 115–117 by means such as punching using a die or laser processing. A conductive paste electrode or layer 114 is then printed on the first to third ferrite sheets 115–117 to form predetermined patterns. For example, an Ag-based metal paste forms the conductive paste layers 114.

Next, these first to third ferrite sheets 115–117 are laminated and compressed in a manner that the conductive paste layers between sheets 115–117 are connected through the via holes to form a sheet laminate. The first to third ferrite sheets 115–117 are laminated in a predetermined order as described above referring to FIG. 3.

Thereafter, the sheet laminate is cut so as to have the unit dimensions to obtain a laminate 110. This laminate that has been cut is then heated in air at about 500° C. for 1 hour to remove the binder component. This laminate is further heated in air at about 800 to 900° C. for 2 hours for sintering.

Next, a conductive past is applied to both end surfaces of the laminate 110 by methods such as dipping. The laminate 110 is further sintered in air at about 600° C. for 1 hour to form external electrodes 120. A conductive paste of the same composition as in the formation of internal electrodes is used. Finally, the external electrodes 120 are plated to obtain a multilayer inductor 100.

In such a multilayer inductor 100, a non-magnetic layer 113 formed by a third ferrite sheet 117 is formed in the inner layer of the laminate 110. By this, in the laminate 110, a closed magnetic path is formed in each of the first ferromagnetic layer 111 and the second ferromagnetic layer 112, which are regions divided by the non-magnetic layer 113. One large closed magnetic path is formed in the entire laminate in conventional multilayer inductors. In contrast, in inductor 100 of FIGS. 1–3 magnetic fluxes from ferromagnetic layer 111 are not combined or are significantly weakly combined with the magnetic fluxes from the second ferromagnetic layer 112. Thus there is a magnetic field of different intensity formed in each region 111 and 112 of inductor 100. Thus, the inductance element in each region has different direct-current characteristics.

Figure 4:
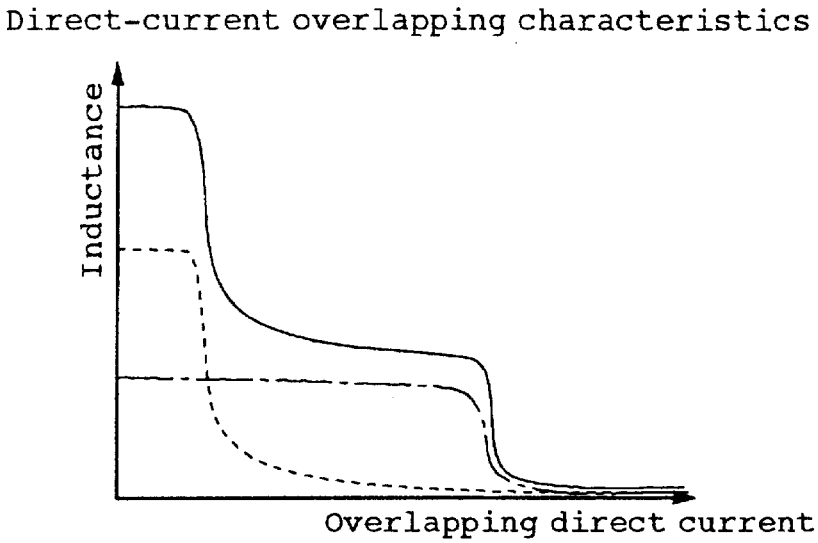
FIG. 4 is a graph of the direct-current characteristics of a multilayer inductor according to the first embodiment of the present invention.

The direct-current characteristics of the multilayer inductor 100 according to this embodiment are described by referring to the graph of FIG. 4. FIG. 4 is a graph of the direct-current characteristics of a multilayer inductor 100 according to the first embodiment, wherein the abscissa indicates direct currents, and the ordinate indicates the inductance. In FIG. 4, the solid line represents the direct-current characteristics of the multilayer inductor 100, the dotted line represents the direct-current characteristics of the inductance element in the first ferromagnetic layer 111, and the dash-and-dot line represents the direct-current characteristics of the inductance element in the second ferromagnetic layer 112.

As can be seen from FIG. 4, the multilayer inductor 100 has a high inductance value in the range where the direct current is relatively small. This inductance value is the sum of the inductance values of the first ferromagnetic layer 111, and the second ferromagnetic layer 112. As the direct current gradually increases to a first value, magnetic saturation occurs in the inductance element in the first ferromagnetic layer 111, causing the inductance value of layer 111 to decrease rapidly as the current in the inductor increases by a small amount. However, since magnetic saturation does not occur in the inductance element in the second ferromagnetic layer 112 when the current has the first value, the inductance value of the multilayer inductor 100 consists mainly of the inductance value of the second ferromagnetic layer 112. As the direct current further increases to a second value, magnetic saturation occurs also in the second ferromagnetic layer 112, causing the inductance value of the multilayer inductor 100 to decrease rapidly.

Thus, the multilayer inductor 100 has direct current characteristics different from conventional multilayer inductors. That is, the multilayer inductor 100 of this embodiment has two inductance values depending on the magnitude of the direct current. Specifically, when the direct current is small, inductor 100 has a high inductance value, and when the direct current is large, inductor 100 has a low inductance value. At intermediate currents, inductor 100 has an intermediate inductance. Therefore, the multilayer inductor 100 is suitable for uses such as a choke coil in a switching power circuit of a small device having a power-saving mode as described above. Since the magnetic field intensity in each of regions 111 and 112 divided by the non-magnetic layer 113 is smaller than the magnetic field intensity of a conventional multilayer inductor, the inductance value of the multilayer inductor 100 is small. Multilayer inductors having desired inductance values as well as different selected direct-current characteristics up to a desired current value can be obtained by adjusting the number of divisions of the laminate or the pattern of the internal electrodes.

Figure 5:
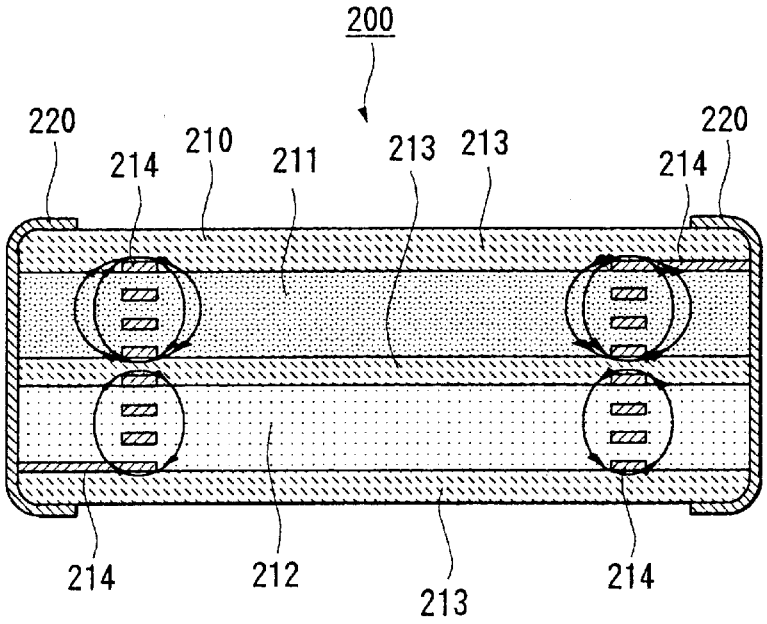
FIG. 5 is a sectional view of a multilayer inductor according to a second embodiment of the present invention.
Figure 6:
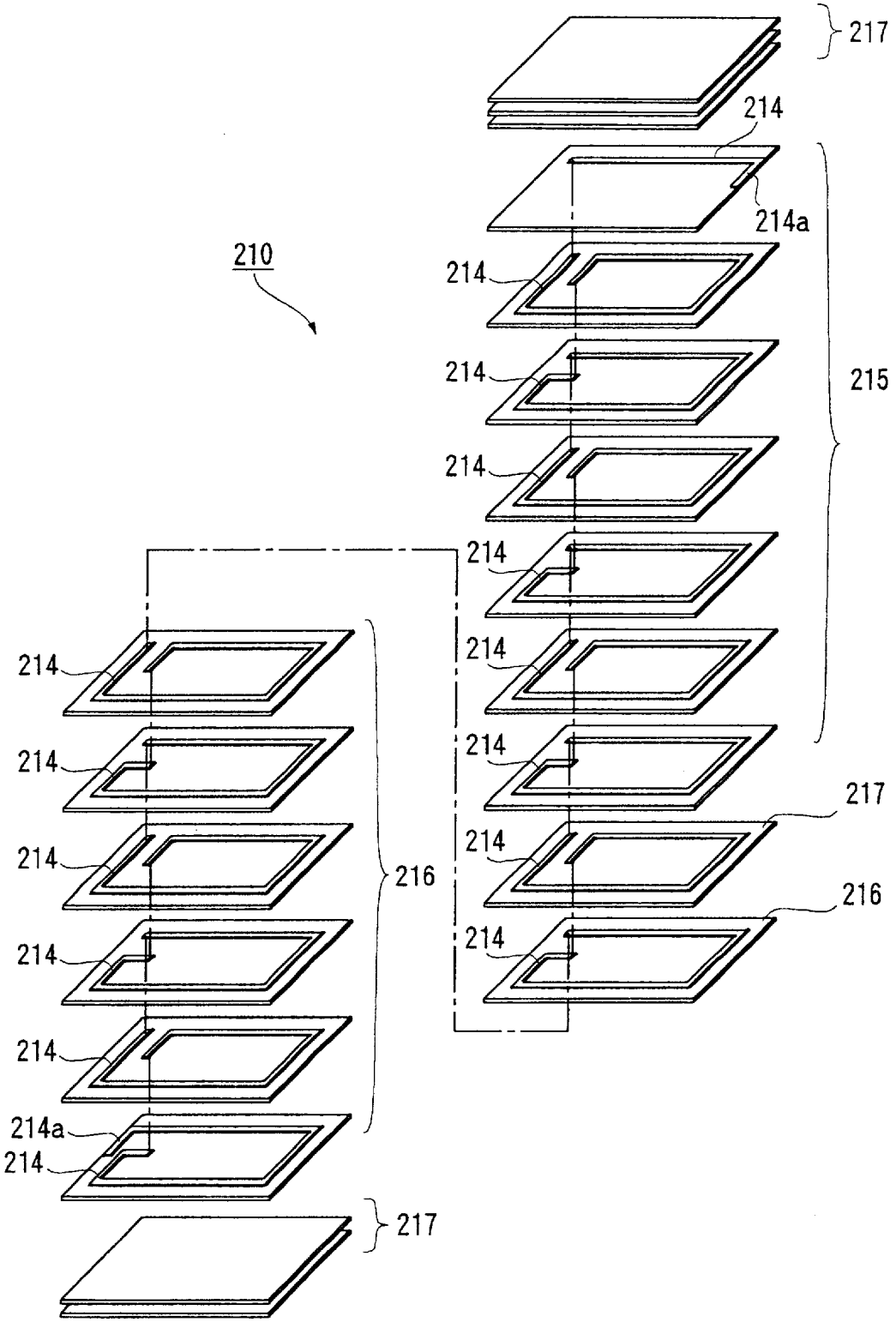
FIG. 6 is an exploded perspective view of a laminate according to the second embodiment of the present invention.
Figure 7:
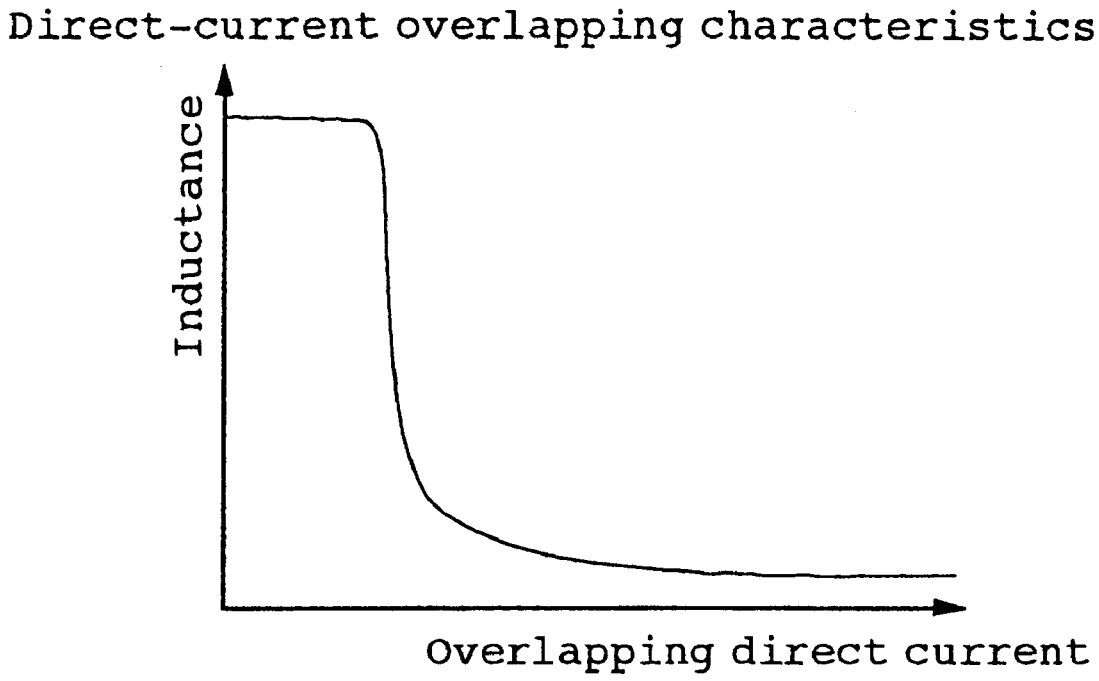
Fig. 7 (PRIOR ART)
FIG. 7 is a graph of direct-current characteristics of a conventional multilayer inductor.

A second embodiment of the present invention is described below by referring to FIGS. 5 and 6. FIG. 5 is a sectional view of a multilayer inductor 200 according to the second embodiment, and FIG. 6 is an exploded perspective view of the laminate of inductor 200. For the convenience of description, the number of turns of the coil and the like are different in FIGS. 5 and 6.

The multilayer inductor 200 according to this embodiment differs from the multilayer inductor 100 according to the first embodiment in the laminated structure of the laminate 210. Since other constitutions are the same as in the first embodiment, only the differences are described here.

The laminate 210 of multilayer inductor 200 has a structure including a first, high magnetic permeability ferromagnetic layer 211 consisting of an Ni—Zn—Cu ferrite material; a second low magnetic permeability ferromagnetic layer 212 consisting of an Ni—Zn—Cu ferrite material, and non-magnetic layers 213 consisting of a Zn—Cu ferrite material and having a permeability $\mu$ of 1. The difference between inductors 100 and 200 is that the non-magnetic layers 213 are formed in the outer layers of the laminate 210 as well as in the inner layer of inductor 200.

That is, in the laminate 210, as FIG. 6 shows, first ferrite sheets 215 that have a high magnetic permeability, second ferrite sheets 216 that have a magnetic permeability lower than the permeability of the first ferrite sheets 215, and non-magnetic third ferrite sheets 217 are integrally laminated. The first ferrite sheets 215 form the above-described first ferromagnetic layer 211, the second ferrite sheets 216 form the second ferromagnetic layer 212, and the third ferrite sheets 217 form the non-magnetic layer 213. Here, several outer sheets (in FIG. 6, 3 upper layers and 2 lower layers) of the laminate 210 are composed of the third non-magnetic ferrite sheets 217.

Since such a multilayer inductor 200 has non-magnetic layers 213 formed of the third ferrite sheets 217 on the outer layers of the laminate 210, it is difficult for the magnetic fluxes generated in the first ferromagnetic layer 211 and the second ferromagnetic layer 212 to leak out of the multilayer inductor 200. Therefore, a multilayer inductor 200 that can have different selected direct-current characteristics can be obtained. Other advantages, effects, and manufacturing processes are the same as in the first embodiment.

It should be noted that the embodiments described herein are only used as examples, and do not limit the present invention. The scope of the present invention is shown in the attached claims, and all the variations included in the meaning of these claims are included in the scope of the present invention.

For example, in the first and second embodiments, although the non-ferromagnetic layer formed in the inner layer of the laminate is non-magnetic ($\mu$=1), this does not limit the present invention. That is, the layer may be formed of a magnetic substance of a low magnetic permeability to the extent to inhibit the binding of fluxes between ferromagnetic layers. For example, a magnetic substance of a low permeability consisting of a ferrite material of the same system as the ferromagnetic layers can be used. It is preferable in this case, that the low permeability magnetic substance have a permeability of ⅓ or less than the permeability of the ferromagnetic layer of the lowest permeability. Since the difference of the magnetic field intensity is 10 times or more when the difference in the number of turns of the coil winding is twice or more, as long as the permeability is ⅓ or less, the binding with other magnetic fields can be inhibited here.

Also in the first and second embodiments, although one non-ferromagnetic layer is formed in the inner layer of the laminate, that is, although the ferromagnetic region in the laminate is divided into two regions by laminating one third ferrite sheet in the inner layer, this does not limit the present invention. That is, the ferromagnetic region in the laminate can be divided into three or more regions by forming two or more non-ferromagnetic layers in the inner layers of the laminate, in other words, by laminating two or more third ferrite sheets in the inner layers of the laminate. In this case, a multilayer inductor having a more complicated curve of the direct-current characteristics can be obtained.

Furthermore, in the first and second embodiments, although the inductance elements in both magnetic layers are made so that magnetic saturation occurs in response to different direct currents, by constituting the first and second ferromagnetic layers divided by a non-ferromagnetic layer using the same number of the first and second ferrite sheets and by allowing the permeability of both layers to differ, this does not limit the present invention. That is, the inductance elements in each region divided by the non-ferromagnetic layer can be made so magnetic saturation occurs in response to different direct currents, by laminating different numbers of the first and second ferrite sheets of the same permeability. Furthermore, the inductance elements in each region can be made so magnetic saturation occurs in response to different direct currents, by using magnetic substances that have different hysteresis, or by adjusting the number of turns of the coil winding.

Moreover, in the first and second embodiments, although the multilayer inductor has one coil as an example, this does not limit the present invention. For example, the present invention can be a multilayer inductor array, a laminated transformer, or a laminated common-mode choke coil that has a plurality of coils. Furthermore, the present invention can be a laminated liquid-crystal composite part, a laminated filter, and the like that have elements other than the inductor (e.g. capacitor) in a laminate.

Furthermore, in the first and second embodiments, although the laminate is formed by the laminating method, it may be formed by the printing method.

In addition, in the first and second embodiments, although a choke coil in a power circuit is shown as an example of useful applications of the multilayer inductor, the present invention is not limited to it. The multilayer inductor according to the present invention is also useful in other electronic circuits (e.g. signal-related circuits).

What is claimed is:

1. A multilayer component having an inductive impedance comprising a laminate including laminated conductors that form a coil and insulators, wherein:

said conductors are mutually connected so as to form said coil, the coil having an axis in a laminating direction of the insulators;

said laminate comprises a plurality of first insulators including a magnetic substance of high permeability, and at least one second insulator that is located on an inner layer of the laminate and includes a magnetic substance of low permeability or a non-magnetic substance; and said second insulator being located in the laminate in a manner that inductor elements in regions of the coil divided by said second insulator in the laminating direction produce magnetic saturation caused by direct currents of different magnitudes.

2. The multilayer component according to claim 1, wherein the first insulator in a region of the coil divided by said second insulator has a different permeability from the first insulators in other regions of the coil.

3. The multilayer component according to claim 1, wherein the inductor element in the first insulator in a region of the coil divided by said second insulator in the laminating direction has a different number of turns of the coil from the inductor element in other regions of the coil.

4. The multilayer component according to claim 1, wherein the first insulator in a region of the coil divided by the second insulator in the laminating direction has a different thickness from the first insulator in other regions of the coil.

5. A multilayer laminated component having an inductive impedance comprising a first plurality of laminated insulating layers carrying electrical conductors, a second plurality of laminated insulating layers carrying electrical conductors, a layer arrangement laminated to the first and second plurality of layers dividing the first and second plurality of layers from each other, the first and second plurality of laminated insulating layers having different magnetic saturation characteristics such that magnetic flux saturation occurs in the first plurality of layers in response to a first DC current flowing in the electrical conductors carried thereby and magnetic flux saturation occurs in the second plurality of layers in response to a second DC current flowing in the electrical conductors carried thereby, the layer arrangement decoupling at least some of the magnetic flux in the first plurality of laminated layers from the magnetic flux in the second plurality of laminated layers and vice versa.

6. The multilayer laminated component of claim 5 wherein the first plurality of layers have a magnetic permeability substantially greater than the second plurality of layers and the layer arrangement has a magnetic permeability substantially less than the magnetic permeability of the second plurality of layers.

7. The multilayer laminated component of claim 6 wherein the conductors of the first and second plurality of layers are connected to each other to form an inductor.

8. The multilayer laminated component of claim 5 further including a first additional layer abutting a first face of the first plurality of layers opposite from a second face of the first plurality of layers abutting the layer arrangement, the first additional layer being arranged for confining magnetic flux originating in the first plurality of layers substantially to the first plurality of layers.

9. The multilayer laminated component of claim 8 further including a second additional layer abutting a second face of the second plurality of layers opposite from second face of the second plurality of layers abutting the layer arrangement, the second additional layer being arranged for confining magnetic flux originating in the second plurality of layers substantially to the second plurality of layers.

10. The multilayer laminated component of claim 5 wherein the conductors of the first and second plurality of laminated layers respectively form first and second coil segments having plural turns, the number of turns of the first and second plurality of laminated layers differing from each other.

11. The multilayer laminated component of claim 5 wherein the total thicknesses of the first and second plurality of laminated layer differ.

* * * * *